US010815559B2

(12) United States Patent
Yonekura et al.

(10) Patent No.: US 10,815,559 B2
(45) Date of Patent: Oct. 27, 2020

(54) MOLTEN METAL PLATING FACILITY AND METHOD

(71) Applicant: PRIMETALS TECHNOLOGIES JAPAN, LTD., Hiroshima-shi, Hiroshima (JP)

(72) Inventors: Takashi Yonekura, Hiroshima (JP); Masao Tambara, Hiroshima (JP); Masashi Yoshikawa, Hiroshima (JP); Shinji Nanba, Hiroshima (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 160 days.

(21) Appl. No.: 15/756,707

(22) PCT Filed: Feb. 20, 2017

(86) PCT No.: PCT/JP2017/006040
§ 371 (c)(1),
(2) Date: Mar. 1, 2018

(87) PCT Pub. No.: WO2017/187729
PCT Pub. Date: Nov. 2, 2017

(65) Prior Publication Data

US 2018/0251879 A1 Sep. 6, 2018

(30) Foreign Application Priority Data

Apr. 28, 2016 (JP) ..... 2016-090081

(51) Int. Cl.
*C23C 2/20* (2006.01)
*C23C 2/40* (2006.01)
(Continued)

(52) U.S. Cl.
CPC ..... *C23C 2/20* (2013.01); *C23C 2/16* (2013.01); *C23C 2/18* (2013.01); *C23C 2/40* (2013.01)

(58) Field of Classification Search
None
See application file for complete search history.

(56) References Cited

U.S. PATENT DOCUMENTS

2005/0247262 A1* 11/2005 Yoshikawa ..... C23C 2/20 118/101
2009/0191360 A1* 7/2009 Teramoto ..... C23C 2/003 427/595

(Continued)

FOREIGN PATENT DOCUMENTS

FR 1 592 041 A 6/1970
JP 52-99933 A 8/1977

(Continued)

OTHER PUBLICATIONS

Extended European Search Report dated Apr. 20, 2018 in European Application No. 17789018.3.

(Continued)

*Primary Examiner* — Jethro M. Pence
(74) *Attorney, Agent, or Firm* — Birch, Stewart, Kolasch & Birch, LLP

(57) ABSTRACT

Provided are a molten metal plating facility and a method with which degradation in the surface quality of a strip can be prevented by preventing the adhesion of splashes. In a molten metal plating facility and a method for plating a strip (S) with molten metal by guiding the strip (S) into a molten metal bath (Mm) and then guiding the strip (S) upward, a pair of wiping nozzles (12*a*, 12*b*) disposed so as to face a front surface side and a back surface side of the strip (S) guided upward is used to discharge air streams (Ea, Eb) toward a collision point (A) inside the strip (S) such that the (Continued)

first air streams spread out in a strip width direction of the strip (S), and a pair of outer nozzles (15*a,* 15*b*) disposed so as to face a front surface side and a back surface side of an extended plane on an outer side of the strip (S) with respect to the strip width direction, above the wiping nozzles (12*a,* 12*b*) and on each of both outer sides of the strip (S) with respect to the strip width direction is used to discharge air streams (Fa, Fb) toward a collision point (B) within the extended plane and below the collision point (A).

6 Claims, 11 Drawing Sheets

(51) Int. Cl.
*C23C 2/16* (2006.01)
*C23C 2/18* (2006.01)

(56) References Cited

U.S. PATENT DOCUMENTS

2010/0224120 A1* 9/2010 Fujioka ..... C23C 2/20 118/63
2014/0360537 A1* 12/2014 Fukuoka ..... C23C 2/20 134/37

FOREIGN PATENT DOCUMENTS

| | | | |
|---|---|---|---|
| JP | 57-150552 | U | 3/1981 |
| JP | 61-159365 | U | 10/1986 |
| JP | 6-256923 | A | 9/1994 |
| JP | 6-330275 | A | 11/1994 |
| JP | 7-150327 | A | 6/1995 |
| JP | 2011-252180 | A | 12/2011 |
| JP | 5386779 | B2 | 10/2013 |
| JP | 5396996 | B2 | 11/2013 |
| JP | 2014-80673 | A | 5/2014 |
| WO | 2012/172648 | A1 | 12/2012 |

OTHER PUBLICATIONS

Office Action dated Apr. 2, 2019 in corresponding Japanese Application No. 2016-090081 with an English translation.
International Preliminary Report on Patentability dated Nov. 8, 2018 in corresponding International PCT Application No. PCT/JP2017/006040 with English Translation.

* cited by examiner

MOLTEN METAL PLATING FACILITY AND METHOD

TECHNICAL FIELD

The present invention relates to a molten metal plating facility and a molten metal plating method for plating a strip with molten metal.

BACKGROUND ART

FIG. 10 is a schematic diagram for describing a typical molten metal plating facility. FIG. 11 is a cross sectional view taken along line G-G' in FIG. 10, as seen in the direction of the arrow. As shown in FIG. 10, a typical molten metal plating facility basically includes a sink roll 11 and a pair of wiping nozzles 12*a*, 12*b*. The sink roll 11 is disposed in a molten metal bath Mm containing zinc, for instance, and is configured to guide a strip S that travels continuously. Furthermore, the pair of wiping nozzles 12*a*, 12*b* are disposed so as to face the front surface side and the back surface side of the strip S guided upward from the molten metal bath Mm. Further, the pair of wiping nozzles 12*a*, 12*b* are configured to discharge air streams Ea, Eb of gas jet to remove excess molten metal adhering to the strip S.

Accordingly, the strip S is guided into the molten metal bath Mm by the sink roll 11, immersed in the molten metal bath Mm to be plated with molten metal, and is guided outside the molten metal bath Mm (upward). Then, toward each of the front surface and the back surface of the strip S outside the molten metal bath Mm, the wiping nozzles 12*a*, 12*b* discharge air streams Ea, Eb, respectively. The air streams Ea, Eb discharged as described above remove the excess molten metal adhering to the strip S, and thereby the plating thickness of the strip S is adjusted.

CITATION LIST

Patent Literature

Patent Document 1: JPH6-330275A
Patent Document 2: JPS61-159365U (Utility Model)
Patent Document 3: JP5386779B
Patent Document 4: JP5396996B

SUMMARY

Problems to be Solved

In the above described typical molten metal plating facility, as shown in FIG. 10, in a side view, the wiping nozzles 12*a*, 12*b* facing each other discharge the air streams Ea, Eb toward the front surface and the back surface of the strip S in a perpendicular direction or a substantially perpendicular direction. Furthermore, as shown in FIG. 11, in a top view, the air streams Ea, Eb are discharged over a width that is greater than the width of the strip S.

The discharged air streams Ea, Eb hit the front surface and the back surface of the strip S in a perpendicular direction or a substantially perpendicular direction, and thus the flow after hitting becomes unstable. In particular, at an end portion of the strip S, a flow that escapes outward in the strip width direction is generated, as shown in the dotted-line region of FIG. 11. Thus, the peak pressure changes at the end portion of the strip S. When the pressure is low, the wiping performance deteriorates, and the thickness of the molten metal coating Mc (plating) at the end portion increases. That is, at the end portion of the strip S, the thickness of the molten metal coating Mc adhering thereto becomes thicker than in the vicinity of the center section of the strip S with respect to the strip width direction, which is called "edge over-coating". The molten metal coating Mc with an increased thickness overflows and scatters from the edge of the strip S, which produces splashes Ms.

Furthermore, the discharged air streams Ea, Eb hit each other at the outer side of the end portion of the strip S, which generates a turbulent flow. Such a turbulent flow generated as described above spreads out the splashes M scattering from the edge of the strip S, and the splashes M adhere to the vicinity of outlets of the wiping nozzles 12*a*, 12*b*. As the adhering splashes Ms accumulate and develop, the splashes Ms disturb the flow of air streams Ea, Eb from the wiping nozzles 12*a*, 12*b*, which may result in uneven wiping. As a result, the surface quality of the strip S may deteriorate (formation of pattern or defect on the plated surface).

Next, Patent Documents 1 to 4 will be described briefly. Patent Document 1 discloses, in order to solve the above problem, providing a baffle plate on the outer side of the end portion of the strip to reduce splashes. However, if the distance between the strip and the baffle plate is reduced, slight meandering of the strip during travel may cause the strip and the baffle plate to make contact with each other, and the quality of the end portion of the strip may deteriorate. On the other hand, if the distance between the strip and the baffle plate is increased, contact could be avoided, but the baffle plate cannot exert the effect to prevent adhesion of splashes.

Furthermore, Patent Documents 2 to 4 disclose providing an auxiliary nozzle separately from the wiping nozzles. However, the auxiliary nozzles disclosed in Patent Documents 2 to 4 discharge an air stream which mainly hits the end surface of the strip in order to enhance the wiping effect, and thus do not have the effect to prevent adhesion of splashes.

The present invention was made in view of the above issue, and an object is to provide a molten metal plating facility and a molten metal plating method whereby it is possible to prevent adhesion of splashes to prevent deterioration of the surface quality of the strip.

Solution to the Problems

A molten metal plating facility for plating a strip with molten metal by guiding the strip into a molten metal bath and then guiding the strip upward, according to the present invention for solving the above problem, includes: a pair of wiping nozzles disposed so as to face a front surface side and a back surface side of the strip guided upward and being configured to discharge first air streams toward a first collision point inside the strip such that the first air streams spread out in a strip width direction of the strip; and a pair of outer nozzles disposed so as to face a front surface side and a back surface side of an extended plane on an outer side of the strip with respect to the strip width direction, above the wiping nozzles and on each of both outer sides of the strip with respect to the strip width direction, the outer nozzles being configured to discharge second air streams toward a second collision point within the extended plane and below the first collision point.

A method of plating a strip with molten metal by guiding the strip into a molten metal bath and then guiding the strip upward, according to the present invention for solving the above problem, includes: by using a pair of wiping nozzles disposed so as to face a front surface side and a back surface side of the strip guided upward, discharging first air streams toward a first collision point inside the strip, such that the first air streams spread out in a strip width direction of the strip; and by using a pair of outer nozzles disposed so as to face a front surface side and a back surface side of an extended plane on an outer side of the strip with respect to the strip width direction, above the wiping nozzles and on each of both outer sides of the strip with respect to the strip width direction, discharging second air streams toward a second collision point within the extended plane and below the first collision point.

Advantageous Effects

According to the present invention, it is possible to prevent adhesion of splashes and prevent deterioration of the surface quality of the strip.

The baffle plate shown in Patent Document 1 may make contact with an end portion of a strip as an object. In the present invention, the second air streams discharged from the outer nozzles are used, and thus there is no risk of contact with an end portion of a strip as an object. Furthermore, the auxiliary nozzle shown in Patent Documents 2 to 4 is not disposed on the outer side of the end portion of the strip with respect to the plate width direction, and does not form an air stream on the outer side of the end portion of the strip with respect to the plate width direction. Thus, the auxiliary nozzle cannot prevent adhesion of splashes, in contrast to the present invention.

DETAILED DESCRIPTION

Embodiments of the molten metal plating facility according to the present invention will now be described in detail with reference to FIGS. 1 to 9. The molten metal plating method according to the present invention is to be performed in the molten metal plating facility of each example, as described below.

Working Example 1

Figure 1:
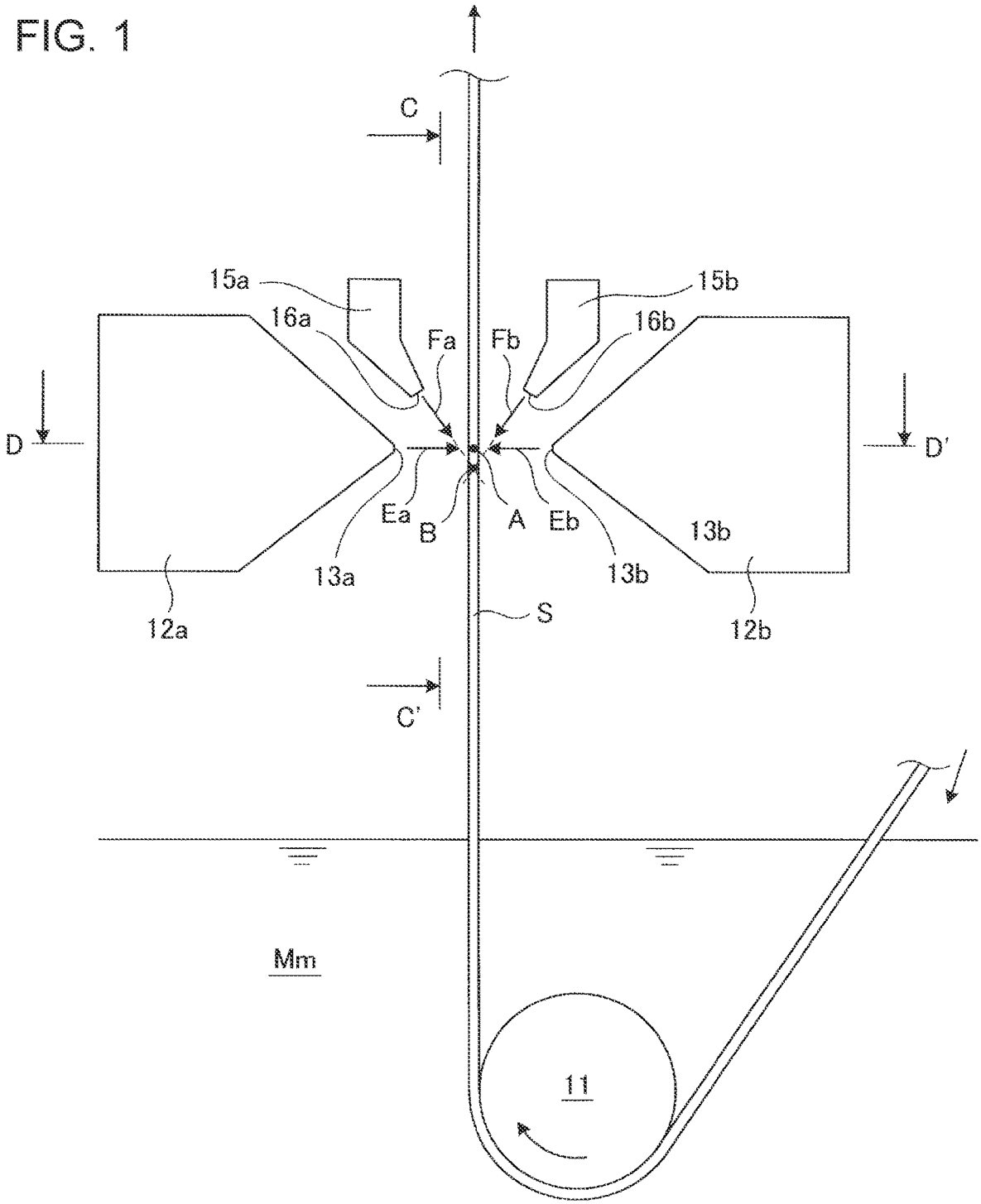
FIG. 1 is a schematic diagram for describing an example (working example 1) of an embodiment of the molten metal plating facility according to the present invention.
Figure 10:
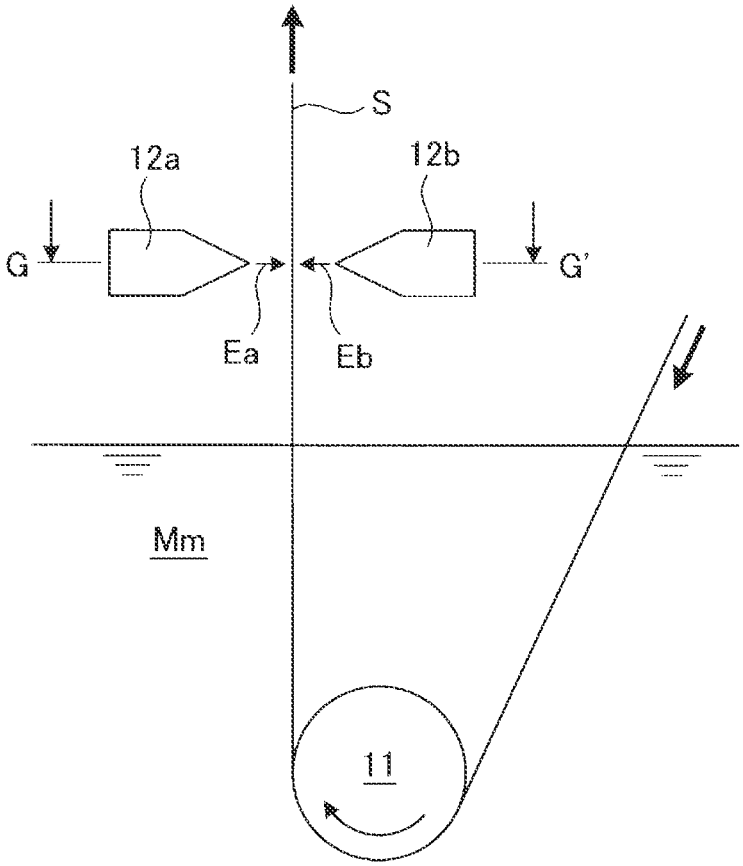
FIG. 10 is a schematic diagram for describing a typical molten metal plating facility.
Figure 11:
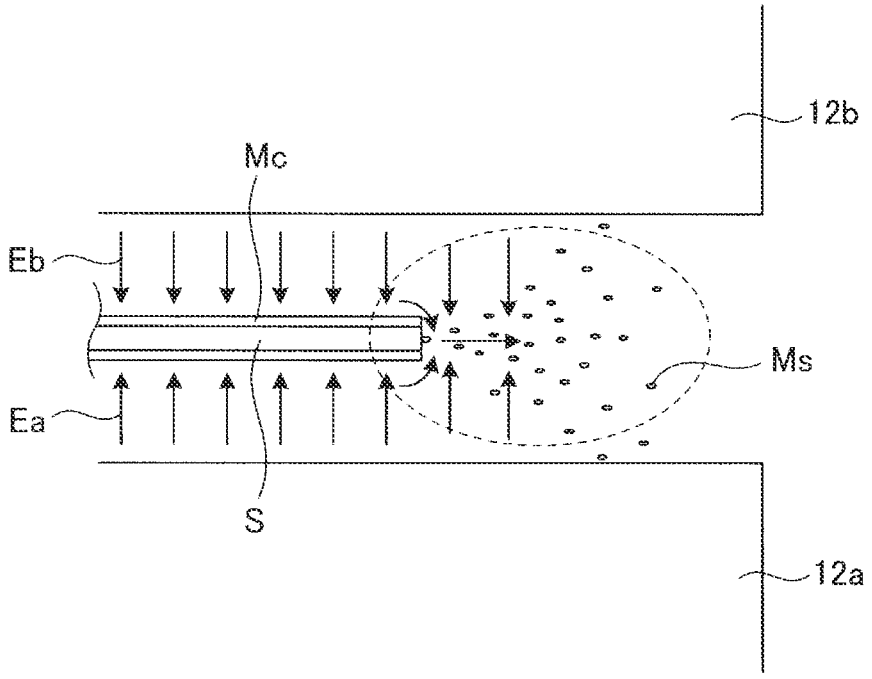
FIG. 11 is a cross-sectional view taken along line G-G' in FIG. 10 in the direction of the arrow.

The molten metal plating facility of the present working example is based on a typical molten metal plating facility shown in FIGS. 10 and 11. That is, as shown in FIG. 1, the molten metal plating facility basically includes a sink roll 11 and a pair of wiping nozzles 12*a*, 12*b*. Similarly to the typical configuration, the sink roll 11 is disposed inside a molten metal bath Mm containing zinc, for instance, and is configured to guide a strip S that travels continuously. Furthermore, similarly to the typical configuration, the pair of wiping nozzles 12*a*, 12*b* are disposed to face the front surface side and the back surface side of the strip S guided upward from the molten metal bath Mm. Further, the pair of wiping nozzles 12*a*, 12*b* are configured to discharge air streams Ea, Eb of gas jet to remove excess molten metal adhering to the strip S. Herein, the same features as those in a typical molten metal plating facility shown in FIGS. 10 and 11 are associated with the same reference numerals.

Figure 3:
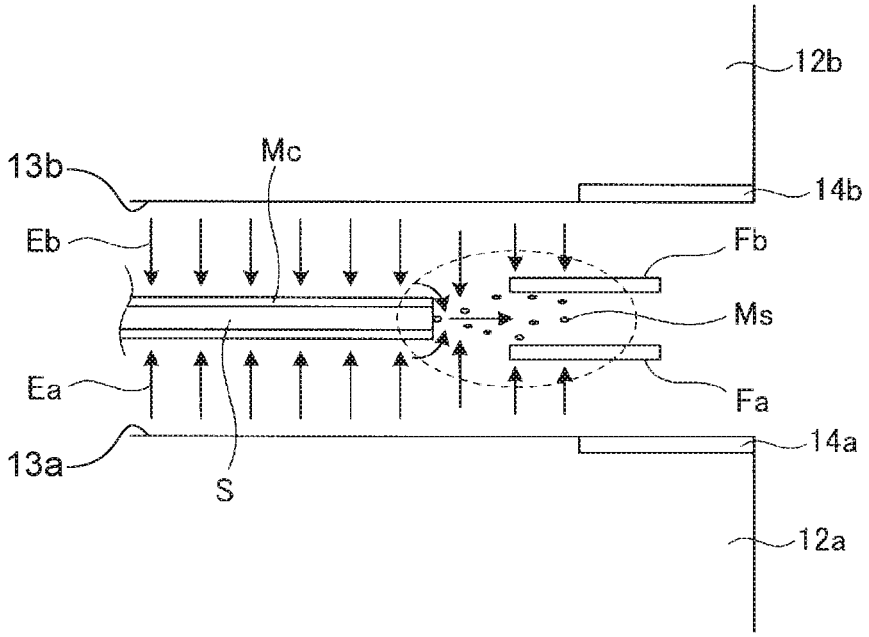
FIG. 3 is a cross-sectional view taken along line D-D' in FIG. 1 in the direction of the arrow.

As shown in FIG. 1, in a side view, the wiping nozzles 12*a*, 12*b* facing each other are configured to discharge the air streams Ea, Eb (first air streams) toward the front surface and the back surface of the strip S in a perpendicular direction or a substantially perpendicular direction, toward the collision point A (first collision point) inside the strip. Furthermore, as shown in FIG. 3, in a top view, the wiping nozzles 12*a*, 12*b* have outlets 13*a*, 13*b* elongated in the strip width direction, so as to discharge the air streams Ea, Eb over a width that is greater than the strip width of the strip S. While the outlets 13*a*, 13*b* normally have the same width as the strip width of the strip S, the width may be slightly greater or smaller.

Figure 2:
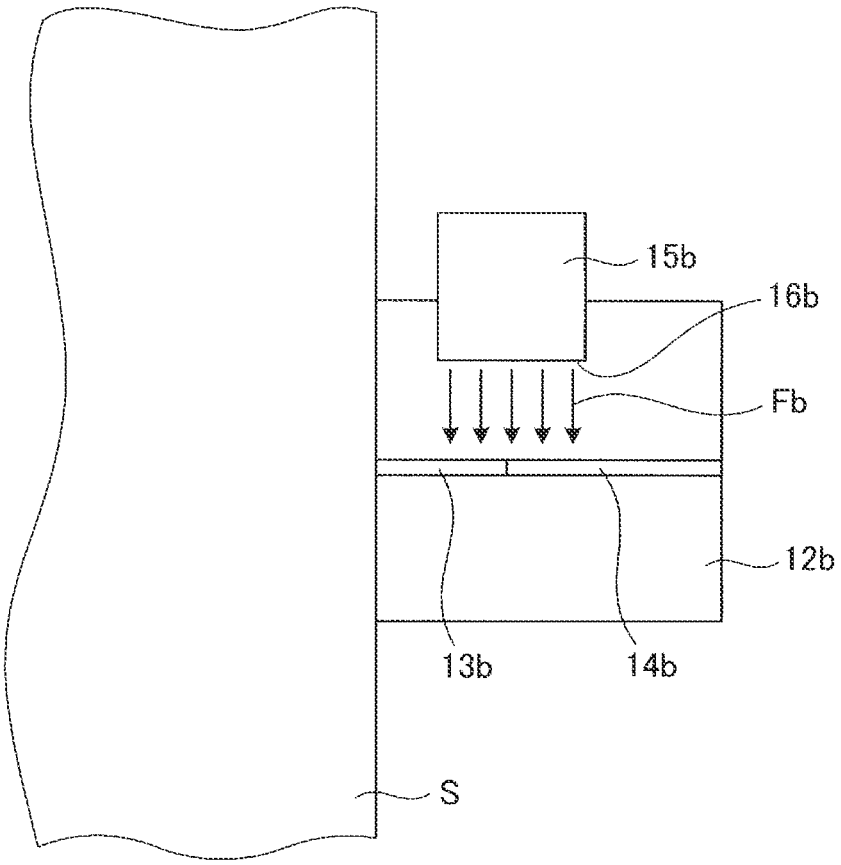
FIG. 2 is a cross-sectional view taken along line C-C' in FIG. 1 in the direction of the arrow.

As shown in FIGS. 2 and 3, the outlets 13*a*, 13*b* may include masks 14*a*, 14*b* that cover the outlets 13*a*, 13*b*. The width of the outlets 13*a*, 13*b*, with respect to the strip width direction, can be changed by moving the masks 14*a*, 14*b* in the strip width direction in accordance with the strip width of the strip S. Thus, even if the width of the strip S changes, the air streams Ea, Eb are discharged in accordance with the strip width of the strip S, or slightly longer or shorter than the same. The masks 14*a*, 14*b* may be configured such that the positions of the masks 14*a*, 14*b* are adjustable depending on the strip width of the strip S, on the basis of the strip end position of the end portion of the strip S detected by a strip end detection sensor 21 described below.

In addition to the above described configuration, the molten metal plating facility of the present working example includes two pairs of outer nozzles 15*a*, 15*b*. The two pairs of outer nozzles 15*a*, 15*b* are disposed above the wiping nozzles 12*a*, 12*b*, on both outer sides of the strip S with respect to the strip width direction. Further, the two pairs of outer nozzles 15*a*, 15*b* are disposed so as to face the front surface side and the back surface side of a virtual extended plane (not shown) on the outer side of the strip S with respect to the strip width direction, respectively. In other words, the pair of outer nozzles 15*a*, 15*b* are disposed plane-symmetrically with reference to the extended plane.

As shown in FIG. 1, the outer nozzles 15*a*, 15*b* have outlets 16*a*, 16*b*, which discharge gas jet air streams Fa, Fb (second air streams) from above the outlets 13*a*, 13*b* of the wiping nozzles 12*a*, 12*b*. The air streams Fa, Fb are discharged toward the collision point B (second collision point)

disposed within the extended plane and below the collision point A. That is, the positions and inclinations of the outer nozzles 15*a*, 15*b* (outlets 16*a*, 16*b*) are set so as to discharge the air streams Fa, Fb toward the collision point B below the collision point A of the air streams Ea, Eb, from above the air streams Ea, Eb.

Further, as shown in FIGS. 1 to 3, the outer nozzles 15*a*, 15*b* (outlets 16*a*, 16*b*) are configured to form air streams Fa, Fb having a predetermined width in the strip width direction, on the outer side of an end portion of the strip S with respect to the strip width direction. For instance, the outlets 16*a*, 16*b* may have a linear shape elongated in the strip width direction. Further, the outer nozzles 15*a*, 15*b* (outlets 16*a*, 16*b*) are configured such that the air streams Fa, Fb having a predetermined width are parallel to each other along the strip width direction as seen from above (see FIG. 3). For instance, the outlets 16*a*, 16*b* having a linear shape may be disposed parallel to each other along the strip width direction. Note that since the outer nozzle 15*a* and the outlet 16*a* are disposed plane-symmetrically to the outlet nozzle 15*b* and the outlet 16*b* with respect to the extended plane of the strip S, the outer nozzle 15*a* and the outlet 16*a* are hidden behind the outer nozzle 15*b* and the outlet 16*b* and thus invisible in FIG. 2. Moreover, FIG. 3 is a cross-sectional view taken along line D-D' in FIG. 1 (a view showing a position below the outer nozzles 15*a*, 15*b* and the outlets 16*a*, 16*b*), and thus does not show the outer nozzles 15*a*, 15*b* and the outlet 16*a*, 16*b*, but show the air streams Fa, Fb discharged from the outer nozzles 15*a*, 15*b* and the outlets 16*a*, 16*b*.

Also in the molten metal plating facility of the present working example having the above described configuration, the strip S is guided into the molten metal bath Mm by the sink roll 11, immersed in the molten metal bath Mm, and is guided outside the molten metal bath Mm (upward). Accordingly, a molten metal coating Mc is formed on the strip S, and plating is applied. Then, toward each of the front surface and the back surface of the strip S outside the molten metal bath Mm, the wiping nozzles 12*a*, 12*b* discharge air streams Ea, Eb, respectively. The air streams Ea, Eb discharged as described above remove the excess molten metal from the strip S, and thereby the plating thickness of the molten metal coating Mc (plating) adhering to the strip S is adjusted.

Also in the typical molten metal plating facility of the present working example, the wiping nozzles 12*a*, 12*b* facing each other discharge the air streams Ea, Eb toward the front surface and the back surface of the strip S in a perpendicular direction or a substantially perpendicular direction in a side view, as shown in FIG. 1. Furthermore, as shown in FIG. 3, in a top view, the air streams Ea, Eb are discharged over a width that is greater than the strip width of the strip S.

Thus, also in the molten metal plating facility of the present working example, the discharged air streams Ea, Eb hit the front surface and the back surface of the strip S in a perpendicular direction or a substantially perpendicular direction, and thus the flow after hitting becomes unstable. In particular, at an end portion of the strip S, a flow that escapes outward in the strip width direction is generated, as shown in the dotted-line region of FIG. 3. Furthermore, the discharged air streams Ea, Eb hit each other at the outer side of the end portion of the strip S, and generate a turbulent flow. Thus, similarly to the typical molten metal plating facility, edge over-coating occurs, and splashes Ms scatter from the edge of the strip S.

However, in the molten metal plating facility of the present working example, outer nozzles 15*a*, 15*b* are provided separately from the wiping nozzles 12*a*, 12*b*. The air streams Fa, Fb from the outer nozzles 15*a*, 15*b* form two gas curtains of the air streams Fa, Fb, on the outer side of each end portion of the strip S with respect to the strip width direction. The two gas curtains of the air streams Fa, F form a space like a V-shaped groove whose bottom is the collision point B.

Then, before spreading out, the splashes Ms scattering from the edge of the strip S (in particular, edge at the collision point A) are trapped inside the space (like a V-shaped groove) between the gas curtains formed by the air streams Fa and Fb. Then, the splashes Ms are incorporated into the air streams Fa and Fb to be entrained, and thereby blown off downward. Accordingly, unlimited diffusion of the splashes M scattering from the edge of the strip S is prevented, and adhesion of the splashes M to the outlets 13*a*, 13*b* of the wiping nozzles 12*a*, 12*b* is prevented.

In the above configuration, the splashes Ms may pass between the two air streams Fa, Fb without being entrained by the air streams Fa, Fb. To reduce such risk, it is desirable to situate the collision point B of the two air streams Fa, Fb at where the splashes Ms from the strip S are produced, that is, below and in the vicinity of the collision point A.

Further, the air stream Fa and the air stream Fb having a predetermined width may not necessarily be parallel along the strip width direction, and the outer nozzles 15*a*, 15*b* (outlets 16*a*, 16*b*) may be configured such that the distance between the air streams Fa, Fb decreases (narrows) toward the outer side in the strip width direction. In this case, it is desirable to change the angle of the outlets 16*a*, 16*b* closer to the vertical direction toward the outer side in the strip width direction, so as to ensure that the collision point B is always below the collision point A. Further, in this case, the shape of the outlets 16*a*, 16*b* is not limited to a linear shape, and may be a staircase shape or curved shape.

Furthermore, in the above configuration, it is desirable that the pressures (discharge pressures) of the air streams Fa, Fb at the outer nozzles 15*a*, 15*b* are higher than the pressures (discharge pressures) of the air streams Ea, Eb at the wiping nozzles 12*a*, 12*b*. For instance, in the above configuration, the pressure of gas supplied to the wiping nozzles 12*a*, 12*b* and the pressure of gas supplied to the outer nozzles 15*a*, 15*b* can be set individually. Further, the pressure of the gas supplied to the outer nozzles 15*a*, 15*h* may be set to be higher than the pressure of the gas supplied to the wiping nozzles 12*a*, 12*b*. On the outer side of the end portion of the strip S with respect to the strip width direction, the air streams Fa, Fb interfere with a part of the air streams Ea, Eb. However, the air streams Fa, Fb having greater pressures than the air streams Ea, Eb dominate, and thus it is easier to prevent diffusion of the splashes Ms.

Further, if the pressures of supplied gas cannot be set individually, instead of the pressures, the opening interval in a direction perpendicular to the strip width direction may be different between the outlets 13*a*, 13*b* of the wiping nozzles 12*a*, 12*b* and the outlets 16*a*, 16*b* of the outer nozzles 15*a*, 15*b*. In this case, the opening interval between the outlets 16*a*, 16*b* is set to be greater than the opening interval between the outlets 13*a*, 13*b*, so as to increase the flow rate per unit length in the strip width direction. Accordingly, the air streams Fa, Fb having a greater flow rate per unit length than the air streams Ea, Eb dominate, and thus it is easier to prevent diffusion of the splashes Ms.

Next, the positional relationship of the outer nozzles 15*a*, 15*b* (outlets 16*a*, 16*b*) relative to the strip S and the wiping nozzles 12*a*, 12*b* (outlets 13*a*, 13*b*) will be described with reference to FIGS. 4 and 5. Herein, the strip S is assumed to be traveling through the center position between the wiping nozzles 12*a* and 12*b*.

Figure 4:
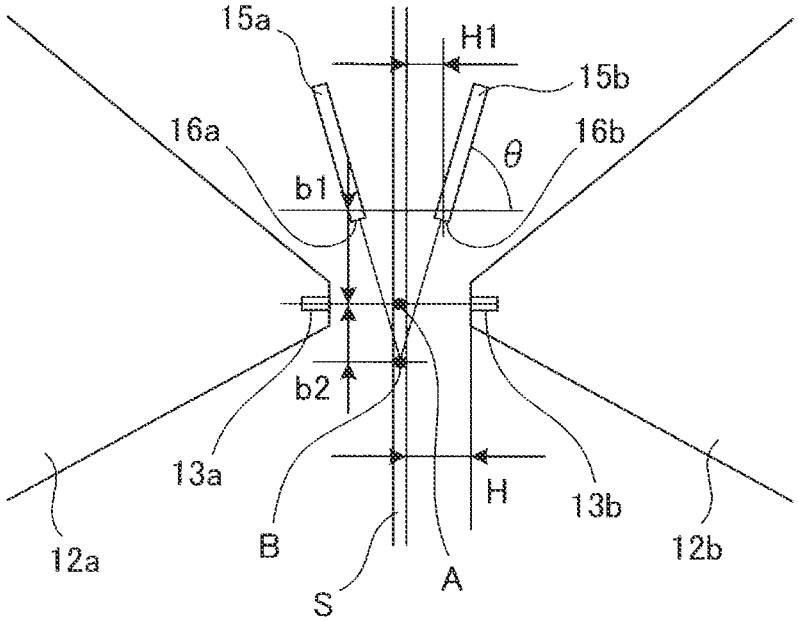
FIG. 4 is a diagram for describing an arrangement relationship of a strip, wiping nozzles, and outer nozzles with respect to the strip thickness direction, in the molten metal plating facility shown in FIG. 1.

Herein, in FIG. 4, the inclination θ is the inclination of the outlets 16*a*, 16*b* of the outer nozzles 15*a*, 15*b* with respect to the horizontal direction, i.e., the inclination of the air streams Fa, Fb with respect to the horizontal direction. Furthermore, the distance H is the distance in the strip thickness direction from the tips of the outlets 13*a*, 13*b* of the wiping nozzles 12*a*, 12*b* to the surface of the strip S. Furthermore, the distance H1 is the distance in the strip thickness direction from the tips of the outlets 16*a*, 16*b* of the outer nozzles 15*a*, 15*b* to the surface of the strip S. Furthermore, the distance b1 is the distance in the height direction from the tips of the outlets 16*a*, 16*b* of the outer nozzles 15*a*, 15*b* to the collision point A. Furthermore, the distance b2 is the distance in the height direction from the collision point A to the collision point B.

Figure 5:
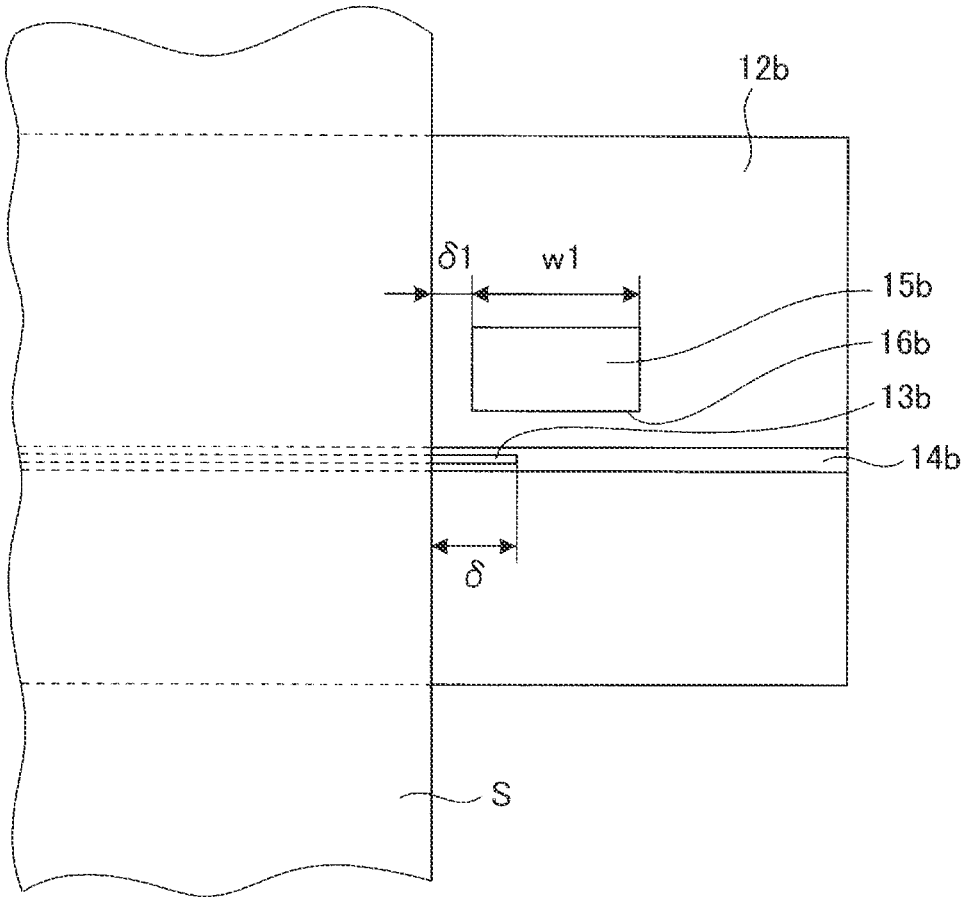
FIG. 5 is a diagram for describing an arrangement relationship of a strip, wiping nozzles, and outer nozzles with respect to the strip width direction, in the molten metal plating facility shown in FIG. 1.

Furthermore, in FIG. 5, the distance δ is the distance in the strip width direction from the end portion of the strip S to the end portions of the outlets 13*a*, 13*b* of the wiping nozzles 12*a*, 12*b*. Furthermore, the distance δ1 is the distance of the gap in the strip width direction between the end portion of the strip S and the outer nozzles 15*a*, 15*b* (outlets 16*a*, 16*b*). Furthermore, the width w1 is the width in the strip width direction of the outer nozzles 15*a*, 15*b* (outlets 16*a*, 16*b*).

Further, for the outer nozzles 15*a*, 15*b* (outlets 16*a*, 16*b*), the following positions (distance H1, b1, δ1) and the inclination θ are adjusted. For instance, a mechanism is provided to adjust the positions of the collision point A (first collision point) and the collision point B (second collision point) described above. It is useful to adjust the positions to enable operation under optimum conditions.

(1) Adjust the distances H1, b1, and the inclination θ, so that the collision point B of the air streams Fa, Fb from the outer nozzles 15*a*, 15*b* (outlets 16*a*, 16*b*) is at the strip-thickness center of the strip S in the strip thickness direction.

(2) Adjust the distances H1, b1, and the inclination θ, so that the collision point B of the air streams Fa, Fb from the outer nozzles 15*a*, 15*b* (outlets 16*a*, 16*b*) is lower than the collision point A of the air streams Ea, Eb from the wiping nozzles 12*a*, 12*b* in the height direction.

(3) Situate the outer nozzles 15*a*, 15*b* on the outer side, with respect to the strip width direction, so as to have an interval of the distance M from the end portion of the strip S in the strip width direction.

By adjusting the above distance H1, b1, δ1, and the inclination θ, the collision point B of the air streams Fa, Fb is positioned to be lower than the collision point A at which the splashes Ms are produced. The space like a V-shaped groove formed by two curtains of the air streams Fa, Fb has a bottom at the collision point B below the collision point A, and the extended line of the collision point A in the strip width direction is positioned inside the space like a V-shaped groove.

Further, as the outer nozzles 15*a*, 15*b* are disposed closer to the end portion of the strip S, that is, as the distance 81 decreases, the splashes Ms can be more easily trapped and incorporated. However, if the outer nozzles 15*a*, 15*b* are too close to the end portion of the strip S, the outer nozzles 15*a*, 15*b* may interfere with the air streams Ea, Eb from the wiping nozzles 12*a*, 12*b* and reduce the wiping performance at the end portion of the strip S. Thus, it is desirable to adjust the distances δ1, δ taking into account of this point.

Although not shown in the drawings, the outer nozzles 15*a*, 15*b* (outlets 16*a*, 16*b*) are configured such that the positions and the inclinations are adjustable independently from the wiping nozzles 12*a*, 12*b*. Thus, for instance, even in a case where the position and the inclinations of the wiping nozzles 12*a*, 12*b* are changed, it is possible to adjust the positions and the inclinations of the outer nozzles 15*a*, 15*b* (outlets 16*a*, 16*b*) so as to satisfy the above conditions (1) to (3).

Working Example 2

The molten metal plating facility of the present working example is based on the molten metal plating facility shown in the above working example 1. Thus, the same features as those in the molten metal plating facility of working example 1 shown in FIGS. 1 to 5 are associated with the same reference numerals, and the overlapping configuration is not described again.

The position of each end portion of the strip S shifts due to meandering and a change in the strip width during traveling. In particular, if the traveling speed of the strip S is high, the changing speed of the position of the end portion of the strip S increases, and the positions of the air streams Ea, Eb and the positions of the air streams Fa, Fb may be offset from the initially-set positions in the strip width direction. As a result, the air streams Fa, Fb from the outer nozzles 15*a*, 15*b* may fail to prevent diffusion of the splashes Ms appropriately.

Figure 6:
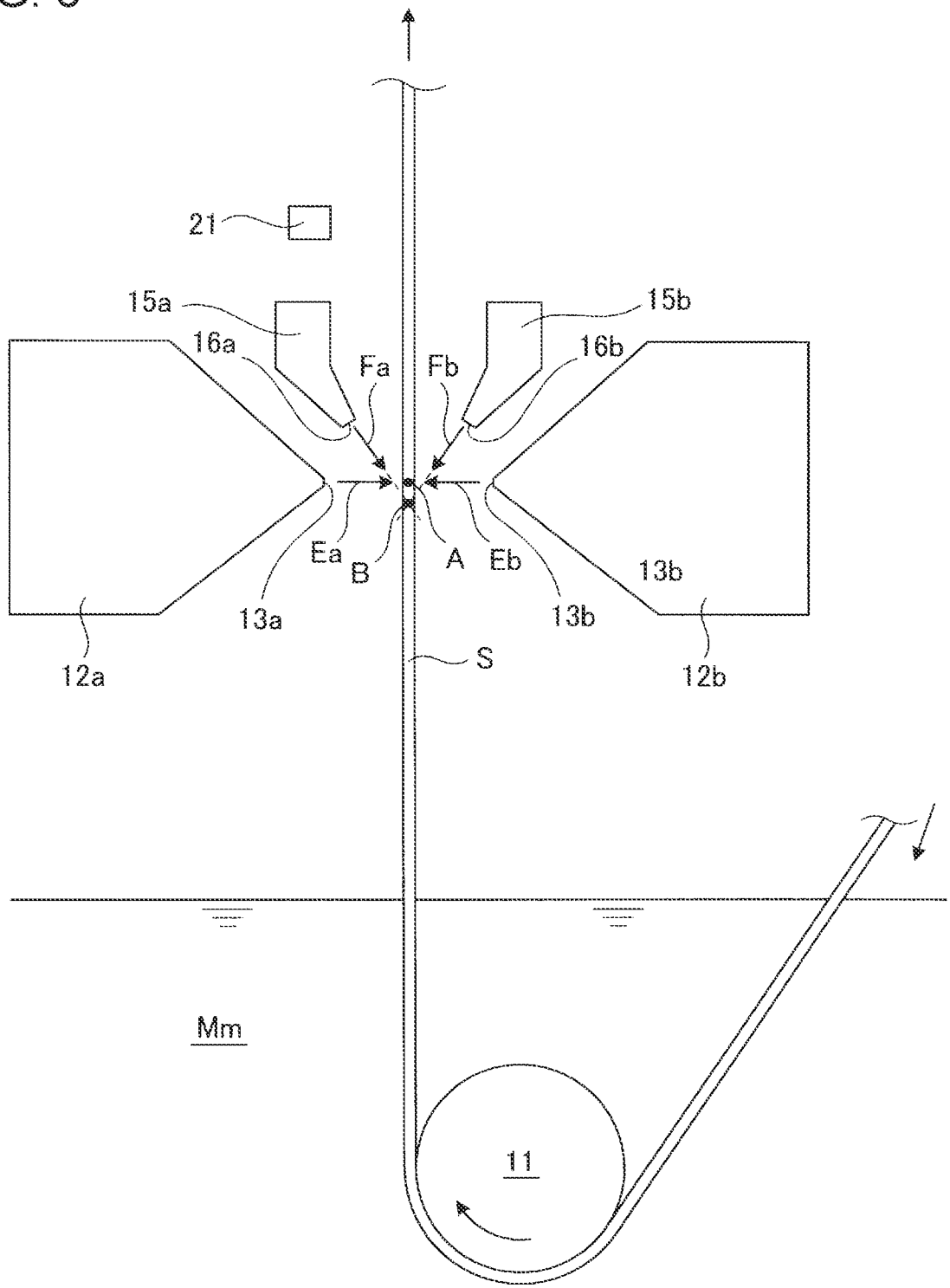
FIG. 6 is a schematic diagram for describing another example (working example 2) of the embodiment of the molten metal plating facility according to the present invention.
Figure 7:
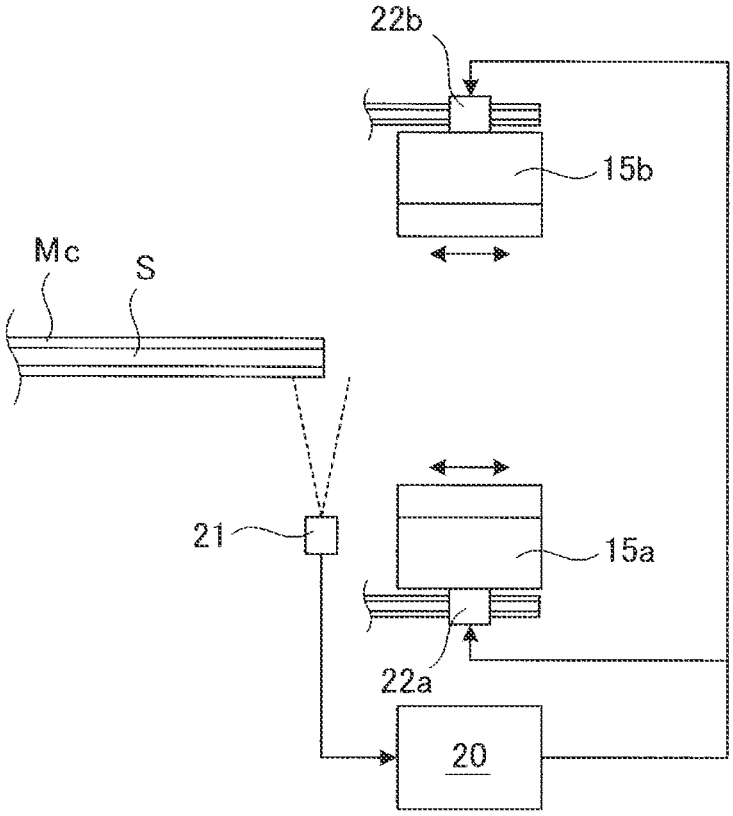
FIG. 7 is a schematic diagram for describing the configuration of a control system, in the molten metal plating facility shown in FIG. 6.

To address the above described problem, as shown in FIGS. 6 and 7, the molten metal plating facility of the present working example further includes a control device 20 (control unit), a strip end detection sensor 21 (strip end detection unit), and driving devices 22*a*, 22*b* (position changing units). While only one end portion of the strip S is shown in FIG. 7, the other end portion has the same configuration.

The strip end detection sensor 21 is, for instance, a camera or a photo sensor or a 2D laser sensor, which detects the strip end position of the end portion of the strip S with respect to the strip width direction, on the basis of image or detection signals. Furthermore, the driving devices 22*a*, 22*b* are each an electric actuator including a ball screw, a linear guide, and a servo motor, for instance, for moving the outer nozzles 15*a*, 15*b* in the strip width direction.

In this configuration, the strip end detection sensors 21 disposed on both end portions constantly detect the strip end positions of both end portions of the strip S. The control devices 20 move the outer nozzles 15*a*, 15*b* to the positions corresponding to the strip end positions, with respect to the strip with direction, on the basis of the detected strip end positions of both end portions of the strip S, by using the driving devices 22*a*, 22*b* provided for each of the end portions.

Similarly, the positions of the outer nozzles 15*a*, 15*b* of each of both end portions with respect to the strip width direction are adjustable in accordance with the strip width of the strip S, and the outer nozzles 15*a*, 15*b* are adjusted to the positions for forming the air streams Fa, Fb on the outer side of each end portion of the strip S in the strip width direction.

With the above configuration, even if the strip S meanders, the strip end positions of both end portions of the strip S are constantly detected by the strip end detection sensors 21, and thus it is possible to adjust the outer nozzles 15*a*, 15*b* to appropriate positions corresponding to the strip end positions. That is, it is possible to maintain the positions of the outer nozzles 15*a*, 15*b* relative to both end portions of the strip S in the strip width direction at constant positions.

Accordingly, it is possible to adjust and maintain an appropriate positional relationship between the splashes Ms produced at each end portion of the strip S and the two air streams Fa, Fb discharged from the outer nozzles 15*a*, 15*b*, in the strip width direction. For instance, the positional relationship as described in FIG. 5 may be achieved. As a result, it is possible to appropriately suppress diffusion of the splashes Ms with the air streams Fa, Fb. Furthermore, it is possible to readily adjust to strips S having different widths.

Working Example 3

The molten metal plating facility of the present working example is also based on the molten metal plating facility shown in the above working example 1. Thus, the same features as those in the molten metal plating facility of working example 1 shown in FIGS. 1 to 5 are associated with the same reference numerals, and the overlapping configuration is not described again.

The strip S may be warped, or the strip S may vibrate when traveling. When the strip S is warped or vibrating, the positions of the air streams Ea, Eb and the positions of the air streams Fa, Fb may be offset from the initially-set positions in the strip thickness direction. As a result, the air streams Fa, Fb from the outer nozzles 15*a*, 15*b* may fail to prevent diffusion of the splashes Ms appropriately.

Figure 8:
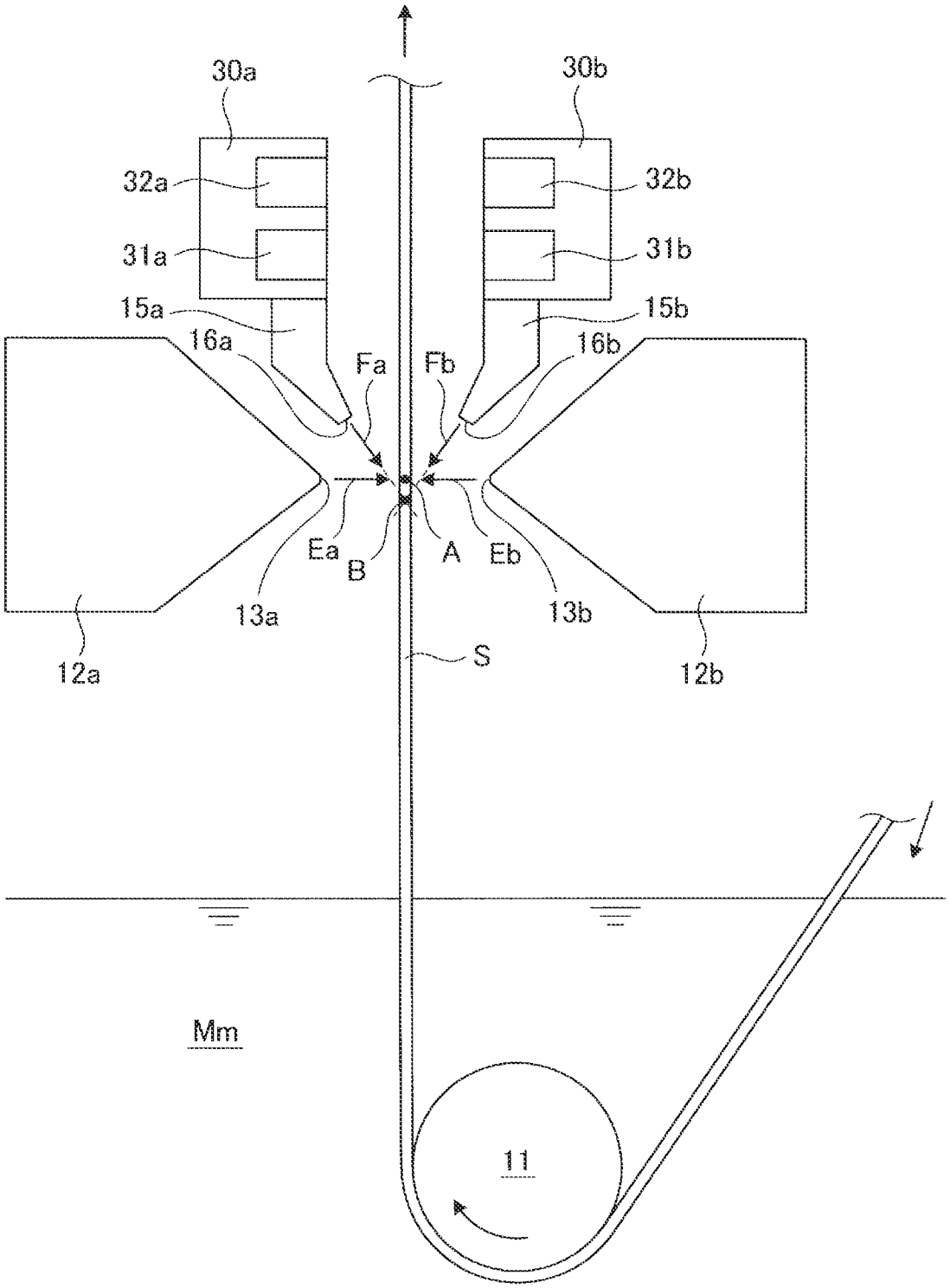
FIG. 8 is a schematic diagram for describing another example (working example 3) of the embodiment of the molten metal plating facility according to the present invention.

To address the above described problem, as shown in FIG. 8, the molten metal plating facility of the present working example further includes a plurality of pairs of vibration control devices 30*a* and 30*b*. Each pair is disposed so that the vibration control devices 30*a* and 30*b* face the front surface side and the back surface side of the strip S coming out from the molten metal bath Mm, and a plurality of such pairs of vibration control devices 30*a*, 30*b* are arranged in the strip width direction. The outer nozzles 15*a*, 15*b* are mounted to the vibration control devices 30*a*, 30*b* of both end portions. The wiping nozzles 12*a*, 12*b* are also attached to the vibration control devices 30*a*, 30*b*. Accordingly, the positional relationship of the vibration control devices 30*a*, 30*b*, the wiping nozzles 12*a*, 12*b*, and the outer nozzles 15*a*, 15*b* is determined.

The above described vibration control device 30*a* includes an electromagnet 31*a* and a displacement sensor 32*a* arranged in this order from below. The vibration control device 30*b* includes an electromagnet 31*b* and a displacement sensor 32*b* arranged in this order from below. The number and arrangement of the electromagnets 31*a*, 31*b*, and the displacement sensors 32*a*, 32*b* may be modified. For instance, another electromagnet may be disposed further above the displacement sensors 32*a*, 32*b*.

In each of the vibration control devices 30*a*, 30*b*, each of the displacement sensors 32*a*, 32*b* (position displacement detection unit) is an eddy-current type sensor, for instance, for detecting the position displacement of the strip S in the strip thickness direction. Furthermore, the electromagnets 31*a*, 31*b* are configured to change the electromagnetic force on the basis of the position displacement detected by the displacement sensors 32*a*, 32*b*, to maintain the position of the strip S in the strip thickness direction at a constant position. It is not always necessary to provide both of the displacement sensors 32*a*, 32*b*. If the displacement sensor 32*a* is not provided, for instance, the electromagnetic force of the electromagnets 31*a*, 31*b* may be changed on the basis of the position displacement detected by the displacement sensor 32*b*.

In this configuration, in each of the vibration control devices 30*a*, 30*b*, the displacement sensors 32*a*, 32*b* disposed to face each other constantly detect the position displacement of the strip S in the strip thickness direction. Furthermore, on the basis of the detected position displacement, the electromagnetic force of each electromagnet 31*a*, 31*b* is controlled so that the strip S is at a constant position between the wiping nozzles 12*a* and 12*b* (normally, center position). Accordingly, a plurality of pairs of vibration control devices 30*a*, 30*b* correct the shape (warp) of the strip S, and control vibration of the strip S.

As described above, the positional relationship of the vibration control devices 30*a*, 30*b*, the wiping nozzles 12*a*, 12*b*, and the outer nozzles 15*a*, 15*b* is constant. Further, even if the strip S warps or vibrates, the vibration control devices 30*a*, 30*b* can adjust the position of the strip S with respect to the strip thickness direction to a constant position between the wiping nozzles 12*a* and 12*b* (e.g. center position). That is, it is possible to maintain the positions of the wiping nozzles 12*a*, 12*b* relative to end portions of the strip S in the strip thickness direction at constant positions. Similarly, it is possible to maintain the positions of the outer nozzles 15*a*, 15*b* relative to end portions of the strip S in the strip thickness direction at constant positions.

Accordingly, it is possible to adjust and maintain an appropriate positional relationship for the splashes Ms produced at each end portion of the strip S and the two air streams Fa, Fb from the outer nozzles 15*a*, 15*b*, in the strip thickness direction. For instance, the positional relationship as described in FIG. 4 may be achieved. As a result, it is possible to appropriately suppress diffusion of the splashes Ms with the air streams Fa, Fb.

Working Example 4

The molten metal plating facility of the present working example is based on the molten metal plating facility shown in the above working example 2, further including the configuration shown in the above working example 3. Thus, the same features as those in the molten metal plating facility of working example 2 and working example 3 shown in FIGS. 5 to 8 are associated with the same reference numerals, and the overlapping configuration is not described again.

Figure 9:
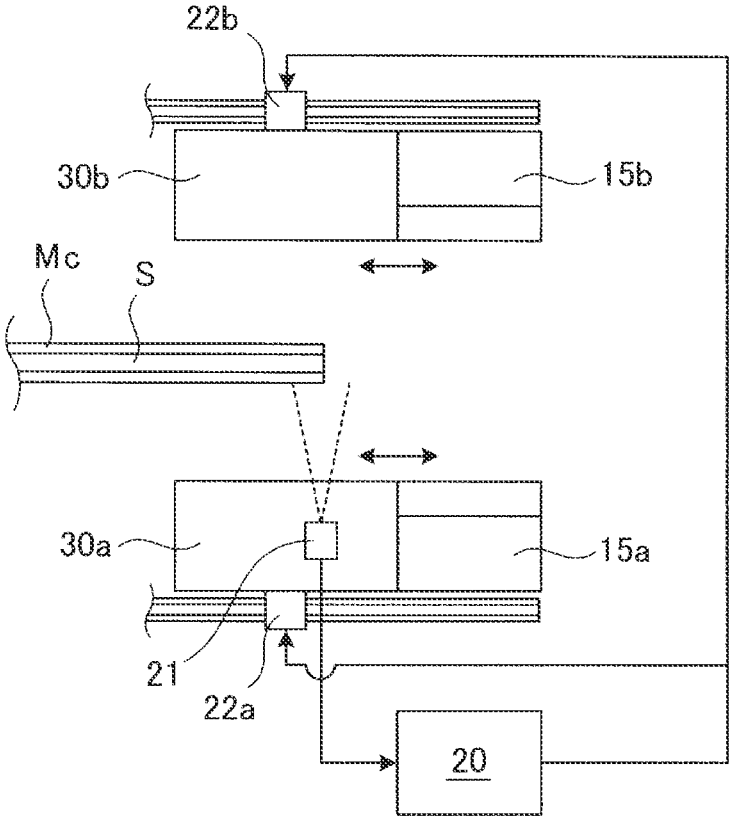
FIG. 9 is a schematic diagram for describing another example (working example 4) of the embodiment of the molten metal plating facility according to the present invention, describing the configuration of the control system.

In the molten metal plating facility according to the present working example, the above described strip end detection sensor 21 is disposed on the vibration control device 30*a* on each of both end portions, as shown in FIG. 9. Furthermore, the above described driving devices 22*a*, 22*b* are configured to be capable of moving the plurality of pairs of vibration control devices 30*a*, 30*b* in the strip width direction. Further, in this case, the wiping nozzles 12*a*, 12*b* are mounted to support members supporting the vibration control devices 30*a*, 30*b* movably. While only one end portion of the strip S is shown in FIG. 9, the other end portion has the same configuration. Furthermore, the number and arrangement of the strip end detection sensors 21 may be changed. For instance, a strip end detection sensor 21 may be disposed on the vibration control device 30*b* on each of both end portions, or on each of the vibration control devices 30*a* and 30*b* on each of both end portions.

In this configuration, the strip end detection sensors 21 at both end portions constantly detect the blade end positions of both end portions of the strip S. The control devices 20 move the vibration control devices 30*a*, 30*b* and the outer nozzles 15*a*, 15*b* on both end portions to the positions corresponding to the strip end positions, with respect to the strip with direction, on the basis of the detected strip end positions of both end portions of the strip S, by using the driving devices 22*a*, 22*b* on both end portions. Furthermore, the vibration control devices 30*a*, 30*b* other than those on both end portions are also moved so as to adjust the distance between adjacent pairs of vibration control devices 30*a*, 30*b* in response to the strip with of the strip S.

In this configuration, in each vibration control device 30*a*, 30*b*, the displacement sensors 32*a*, 32*b* disposed to face each other constantly detect the position displacement of the strip S in the strip thickness direction. Furthermore, on the basis of the detected position displacement, the electromagnetic force of each electromagnet 31*a*, 31*b* is controlled so that the strip S is at a constant position between the wiping nozzles 12*a*, 12*b* (normally, center position).

With the above configuration, similarly to working example 2, even if the strip S meanders, the strip end positions of both end portions of the strip S are constantly detected by the strip end detection sensors 21, and thus it is possible to adjust the vibration control devices 30*a*, 30*b* and the outer nozzles 15*a*, 15*b* of both end portions to appropriate positions corresponding to the strip end positions. Further, similarly to working example 3, even if the strip S warps or vibrates, the vibration control devices 30*a*, 30*b* can adjust the position of the strip S with respect to the strip thickness direction to a constant position between the wiping nozzles 12*a* and 12*b* (e.g. center position). Accordingly, it is possible to adjust and maintain an appropriate positional relationship for the splashes Ms produced at each end portion of the strip S and the two air streams Fa, Fb from the outer nozzles 15*a*, 15*b*, in the strip thickness direction and the strip width direction. As a result, it is possible to appropriately suppress diffusion of the splashes Ms with the air streams Fa, Fb. Furthermore, it is possible to address strips S having different widths easily.

INDUSTRIAL APPLICABILITY

The present invention is preferably applicable to a molten metal plating facility and a molten metal plating method.

DESCRIPTION OF REFERENCE NUMERALS

11 Sink roll
12*a*, 12*b* Wiping nozzle
15*a*, 15*b* Outer nozzle
20 Control device
21 Strip end detection sensor
22*a*, 22*b* Driving device
30*a*, 30*b* Vibration control device
31*a*, 31*b* Electromagnet
32*a*, 32*b* Displacement sensor

The invention claimed is:

1. A molten metal plating facility for plating a strip with molten metal by guiding the strip into a molten metal bath and then guiding the strip upward, the molten metal plating facility comprising:

a pair of wiping nozzles disposed so as to face a front surface side and a back surface side of the strip guided upward and having outlets, respectively, extending in a strip width direction of the strip and directed to a first collision point inside the strip;

a pair of outer nozzles disposed so as to face a front surface side and a back surface side of an extended plane on an outer side of the strip with respect to the strip width direction, above the wiping nozzles and on each of both outer sides of the strip with respect to the strip width direction, the outer nozzles having outlets, respectively, directed to a second collision point within the extended plane and below the first collision point, and masks covering the outlets of the wiping nozzles, a strip end detection unit configured to detect a strip end position of an end portion of the strip with respect to the strip width direction;

wherein each of the outlets of the pair of outer nozzles has a shape elongated in the strip with direction of the strip, the outlets being configured to discharge the second air streams so as to form gas curtains, wherein the molten metal plating facility is configured such that positions of the masks are adjustable depending on a strip width of the strip on the basis of the strip end position detected by the strip end detection sensor, to change a width of the outlets of the wiping nozzles with respect to the strip width direction.

2. The molten metal plating facility according to claim 1, wherein pressures of the second air streams at the outer nozzles are higher than pressures of the first air streams at the wiping nozzles.

3. The molten metal plating facility according to claim 1, further comprising:

a position changing unit configured to move the outer nozzles in the strip width direction; and a control unit configured to move the outer nozzles to a position corresponding to the strip end position by using the position changing unit, on the basis of the strip end position detected by the strip end detection unit.

4. The molten metal plating facility according to claim 1, further comprising:

a vibration control device including a position displacement detection unit configured to detect a position displacement of the strip in a strip thickness direction, and an electromagnet configured to maintain a position of the strip with respect to the strip thickness direction at a predetermined position by changing an electromagnetic force on the basis of the position displacement detected by the position displacement detection unit, wherein the wiping nozzles and the outer nozzles are mounted to the vibration control device.

5. A method of plating a strip with molten metal according to the molten metal plating facility of claim 1 by guiding the strip into the molten metal bath and then guiding the strip upward, the method comprising:

by using the pair of wiping nozzles disposed so as to face the front surface side and the back surface side of the strip guided upward, discharging first air streams toward the first collision point inside the strip, such that the first air streams spread out in the strip width direction of the strip; and by using the pair of outer nozzles disposed so as to face the front surface side and the back surface side of the extended plane on the outer side of the strip with respect to the strip width direction, above the wiping nozzles and on each of both outer sides of the strip with respect to the strip width direction, discharging second air streams toward the second collision point within the extended plane and below the first collision point so as to form the gas curtains.

6. The molten metal plating facility according to claim 1, wherein the pair of outer nozzles are disposed such that the distance between the outlets of the pair of outer nozzles decreases toward the outer side in the strip width direction.

* * * * *